US009169614B2

(12) United States Patent
Miller

(10) Patent No.: US 9,169,614 B2
(45) Date of Patent: Oct. 27, 2015

(54) ATTACHABLE GRAPPLE MOUNTING SYSTEM

(71) Applicant: Timothy D. Miller, Sioux Falls, SD (US)

(72) Inventor: Timothy D. Miller, Sioux Falls, SD (US)

( * ) Notice: Subject to any disclaimer, the term of this patent is extended or adjusted under 35 U.S.C. 154(b) by 144 days.

(21) Appl. No.: 14/021,792

(22) Filed: Sep. 9, 2013

(65) Prior Publication Data

US 2015/0071700 A1 Mar. 12, 2015

(51) Int. Cl.

| | |
|---|---|
| ***E02F 3/413*** | (2006.01) |
| ***E02F 3/36*** | (2006.01) |
| ***E02F 3/40*** | (2006.01) |
| ***E02F 3/96*** | (2006.01) |

(52) U.S. Cl.

CPC ..... *E02F 3/4133* (2013.01); *E02F 3/3604* (2013.01); *E02F 3/404* (2013.01); *E02F 3/962* (2013.01); *Y10T 403/591* (2015.01)

(58) Field of Classification Search

CPC ..... E02F 3/3677; E02F 3/4133

See application file for complete search history.

(56) References Cited

U.S. PATENT DOCUMENTS 4,247,242 A * 1/1981 Goertzen ..... 414/686

* cited by examiner

*Primary Examiner* — Daniel P Stodola
*Assistant Examiner* — Matthieu Setliff
(74) *Attorney, Agent, or Firm* — Jeffrey A. Proehl; Woods, Fuller, Shultz & Smith PC

(57) ABSTRACT

A system for mounting a grapple on a loader attachment having a grapple mount structure, and may comprise a grapple attachment structure removably mountable to the mount structure. A mount pin alignment device may have an abutment surface configured to contact a support surface of the grapple mount structure in the mounted condition, with a position of the alignment device being adjustable to facilitate alignment of a second pin aperture of the attachment structure with a first pin aperture on the mount structure. The system may also include a lateral mount alignment element to laterally position the attachment structure with respect to the mount structure.

20 Claims, 16 Drawing Sheets

ATTACHABLE GRAPPLE MOUNTING SYSTEM

BACKGROUND

Field

The present invention relates to attachable grapples and more specifically relates to attachable grapples and the ease with which the attachable grapples may be mounted on a bucket or other structure from a parked condition on a ground surface.

SUMMARY

In one aspect, the disclosure relates to a mounting system for mounting a grapple on a grapple mount structure for a loader attachment. The grapple may include a grapple arm having a proximal end and a distal end, and the grapple mount structure may include mount plates with a reception space therebetween. The grapple mount structure may form a hook and a first pin aperture and having at least one support surface. The system may comprise a grapple attachment structure located at a proximal end of the grapple arm and being removably mountable to the grapple mount structure. The grapple attachment structure may have a mounted condition and a dismounted condition with respect to the grapple mount structure, and may have a free end positionable in the reception space of the grapple mount structure. The grapple attachment structure may have lateral sides for positioning adjacent to the mount plates of the grapple mount structure. The grapple attachment structure may comprise a hook pin configured to be removably received in the hook of the grapple mount structure when in the mounted condition, with the hook pin extending laterally from at least one of the lateral sides of the grapple attachment structure. The attachment structure may also comprise a second pin aperture alignable with the first pin aperture in the mount plates when the structures are in the mounted condition. A mount pin alignment device may have an abutment surface configured to contact the support surface of the grapple mount structure in the mounted condition, and a position of the alignment device with respect to the hook pin being adjustable to facilitate alignment of the second pin aperture of the grapple attachment structure and the first pin aperture of the grapple mount structure.

In another aspect, the disclosure relates to a mounting system for mounting a grapple on a bucket, and the system may comprise a grapple mount structure configured to mount on the bucket and including mount plates with a reception space therebetween. The grapple mount structure may form a hook and a first pin aperture and having at least one support surface. The system may also comprise a grapple attachment structure configured to mount on a proximal end of a grapple arm and being removably mountable to the grapple mount structure. The grapple attachment structure may have a mounted condition and a dismounted condition with respect to the grapple mount structure, and the grapple attachment structure may have a free end positionable in the reception space of the grapple mount structure. The grapple attachment structure may have lateral sides for positioning adjacent to the mount plates of the grapple mount structure. The grapple attachment structure may comprise a pair of attachment walls forming at least a portion of the lateral sides of the grapple attachment structure and defining an internal space therebetween, and a hook pin configured to be removably received in the hook of the grapple mount structure when in the mounted condition, with the hook pin extending laterally from at least one of the lateral sides of the grapple attachment structure. The attachment structure may also include a second pin aperture alignable with the first pin aperture in the mount plates when the structures are in the mounted condition. The system may also comprise a mount pin alignment device having an abutment surface configured to contact the support surface of the grapple mount structure in the mounted condition, with a position of the alignment device with respect to the hook pin being adjustable to facilitate alignment of the second pin aperture of the grapple attachment structure and the first pin aperture of the grapple mount structure.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1A:
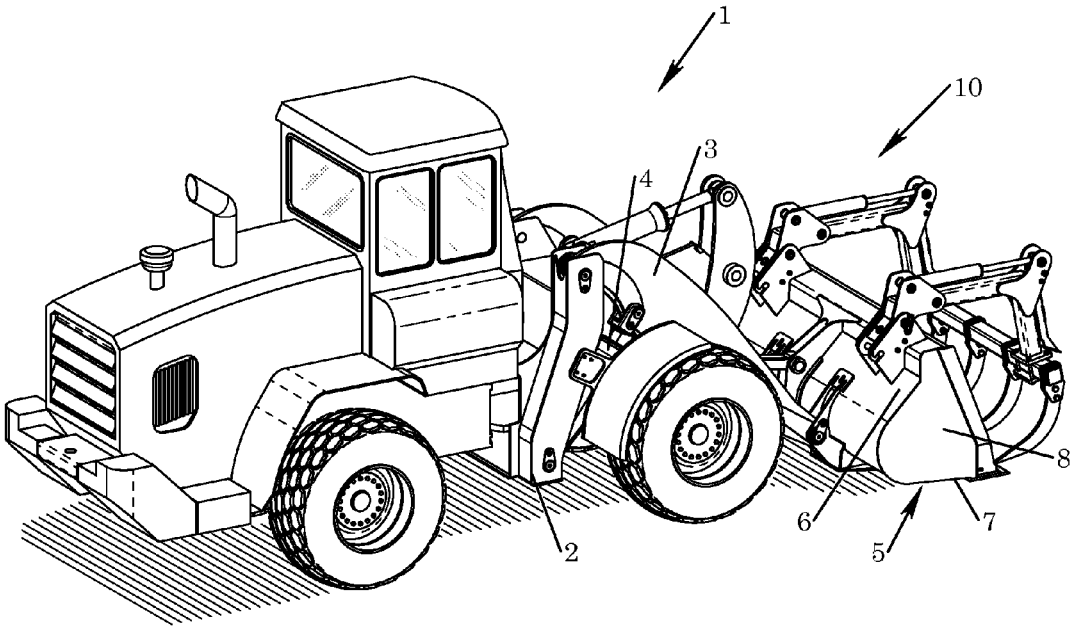
FIG. 1A is a schematic right rear perspective view showing an articulated wheel loader with a bucket and a grapple installed on the bucket.
Figure 1B:
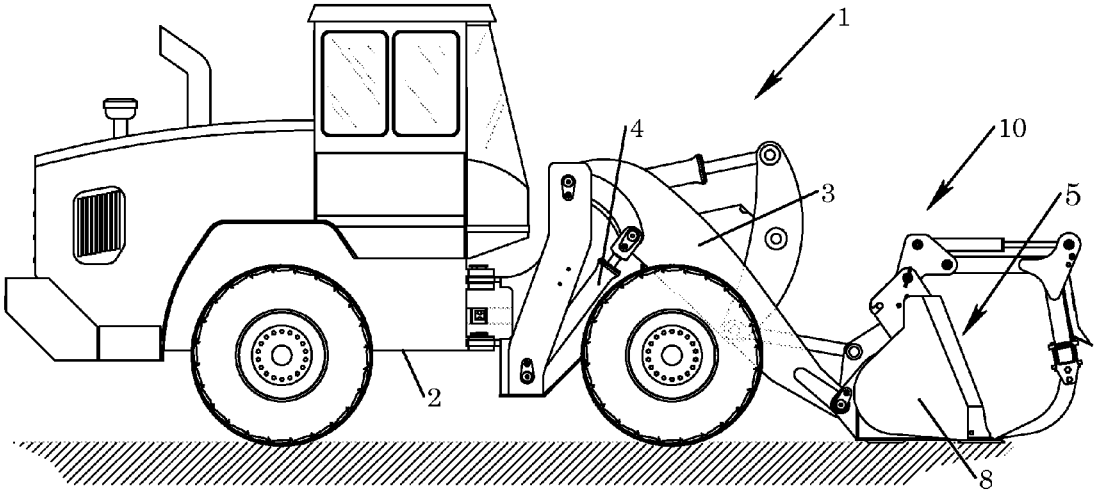
FIG. 1B is a schematic right side view of elements shown in FIG. 1A.
Figure 2:
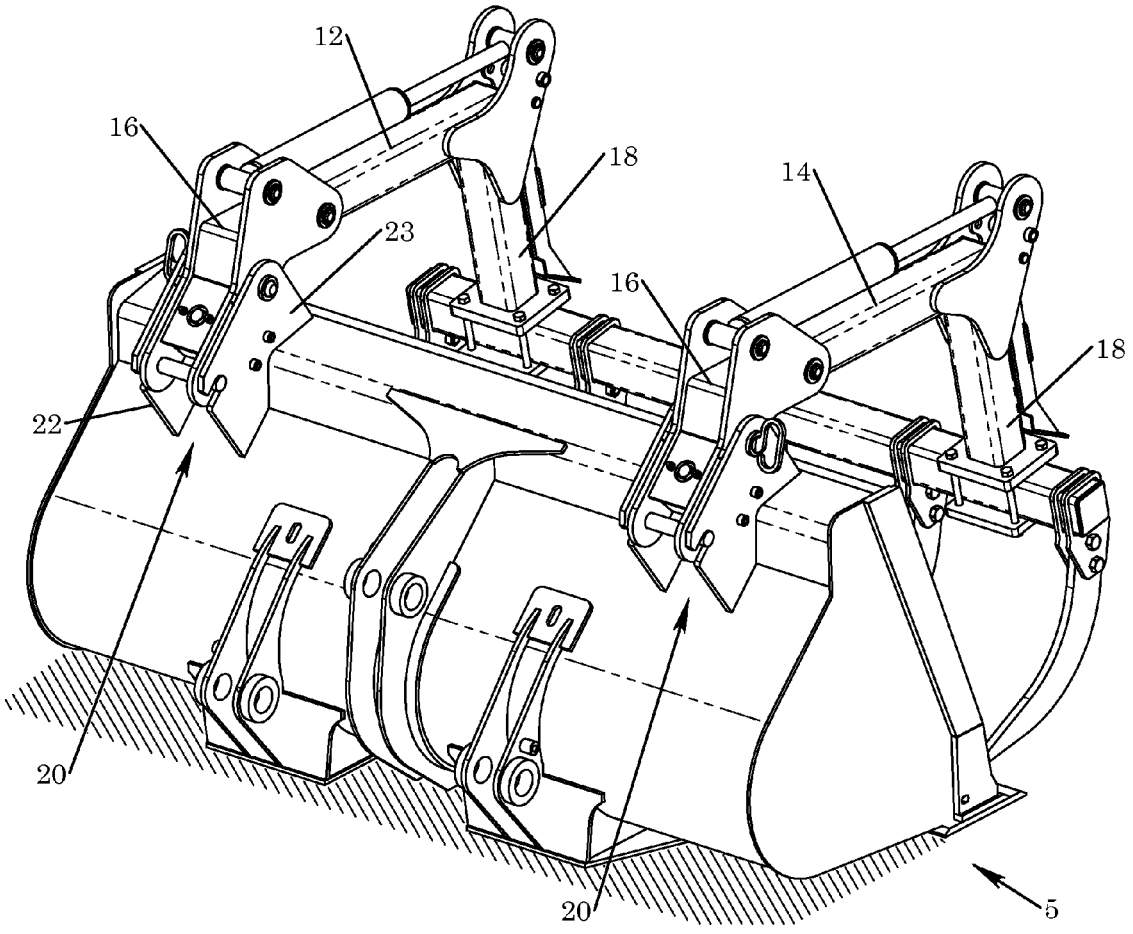
FIG. 2 is a schematic rear perspective view of the bucket isolated from the loader and having the grapple in a mounted condition thereon.

With reference now to the drawings, and in particular to FIGS. 1 through 12 thereof, a new attachable grapple mounting system embodying the principles and concepts of the disclosed subject matter will be described.

Applicant has recognized that attachable grapples for front end loaders usually have no provision for an adjustment to reliably and repeatedly align the holes provided for insertion of a mount pin to complete the attachment. As a result, the attachment task is often accomplished using brute force and heavy tools. In some grapples equipped with adjustment for mount pin hole alignment, there are multiple adjustment points for each mount pin, which multiplies the elapsed time required for adjustment and increases the possibility that the adjustment points are not synchronized with each other. Applicant has further recognized that the added clearances required between the mount pins and the respective aperture bores that make the conventional adjustments possible also introduce slop in the assembly during normal operation of the grapple. The mass of the grapple and the speed at which the bucket and grapple assembly can be manipulated with modern wheel loader hydraulic systems make it highly likely that the limits of the clearances will be reached.

Applicant has devised a system that may advantageously minimize the lateral clearance of the mating parts in the mounted condition while still allowing ease of insertion of the mount pins when mounting the grapple. The system may also beneficially provide a singular, centrally located adjustment device for each mount pin.

In one aspect, the disclosure relates to a loader 1 generally having a forward direction of travel and a rearward direction of travel. The loader may include a mobile frame 2 with axles and wheels mounted on the axles providing the mobility, although other systems such as tracks may be employed. The loader may further include at least one lift arm 3 which may be pivotable with respect to the mobile frame by at least one actuator 4. In most embodiments, a pair of lift arms may be utilized. The loader may also include a bucket 5 that is pivotally mounted on the lift arm or arms 3. The bucket 5 may have an upper wall 6, a lower wall 7 extending to the upper wall from below the upper wall, and end walls 8 extending from the upper and lower walls and closing the ends of the bucket. In many applications, a mount pin 9 may be employed to complete the mounting of an attachment to the bucket, such as a grapple system 10.

The disclosure also relates to a grapple system 10 that may be mounted, and may be removably mounted, on the bucket 5 of a vehicle such as a loader. The grapple system 10 may include a pair of grapple arms 12, 14, and each of the grapple arms may have a proximal end 16 and a distal end 18, with the distal end 18 having a tooth mounted thereon. The grapple arms are typically substantially identical to each other in construction, but this is not critical.

The grapple system 10 may also include a pair of grapple mount structures 20 that are mounted on, or mountable on, the bucket 5. The grapple mount structures 20 may be located on the upper wall 6 of the bucket. The grapple mount structures 20 are preferably but not critically substantially identical in configuration, so the description will be directed to one mount structure with the understanding that the other mount structure may be substantially the same.

Each grapple mount structure 20 may comprise a pair of spaced mount plates 22, 23, which may form a reception space 24 therebetween and may be bounded by the upper wall 6 of the bucket. Each mount plate 22, 23 may have a peripheral edge 26, an inner surface 28 and an outer surface 29. The inner surfaces 28 of the mount plates may define side boundaries of the reception space. Each mount plate may include a hook 30, which may be positioned toward the rearward direction of the loader. In some embodiments, the hook 30 is formed by a portion of the peripheral edge 26 of the mount plate. Each mount plate may further comprise a first pin aperture 32 that extends through the mount plate to receive a mount pin 9. The first pin aperture 32 may be located forwardly of the hook 30 and may be located substantially opposite of the hook 30 on the mount plate 22.

Each grapple mount structure 20 may include at least one support shoulder 34 for facilitating the positioning of a grapple attachment structure 36 located at the proximal end 16 of one of the grapple arms with respect to the mount structure 20 for connecting the attachment structure to the mount structure. The support shoulder 34 may be positioned in the reception space 24, and may be mounted on one of the mount plates 22, 23 on the inner surface 28. A pair of support shoulders 34, 35 may be utilized, with each shoulder being mounted on the inner surface of one of the mount plates in substantial opposition to each other in the reception space. Each of the support shoulders 34, 35 may have a support surface 38.

Figure 3A:
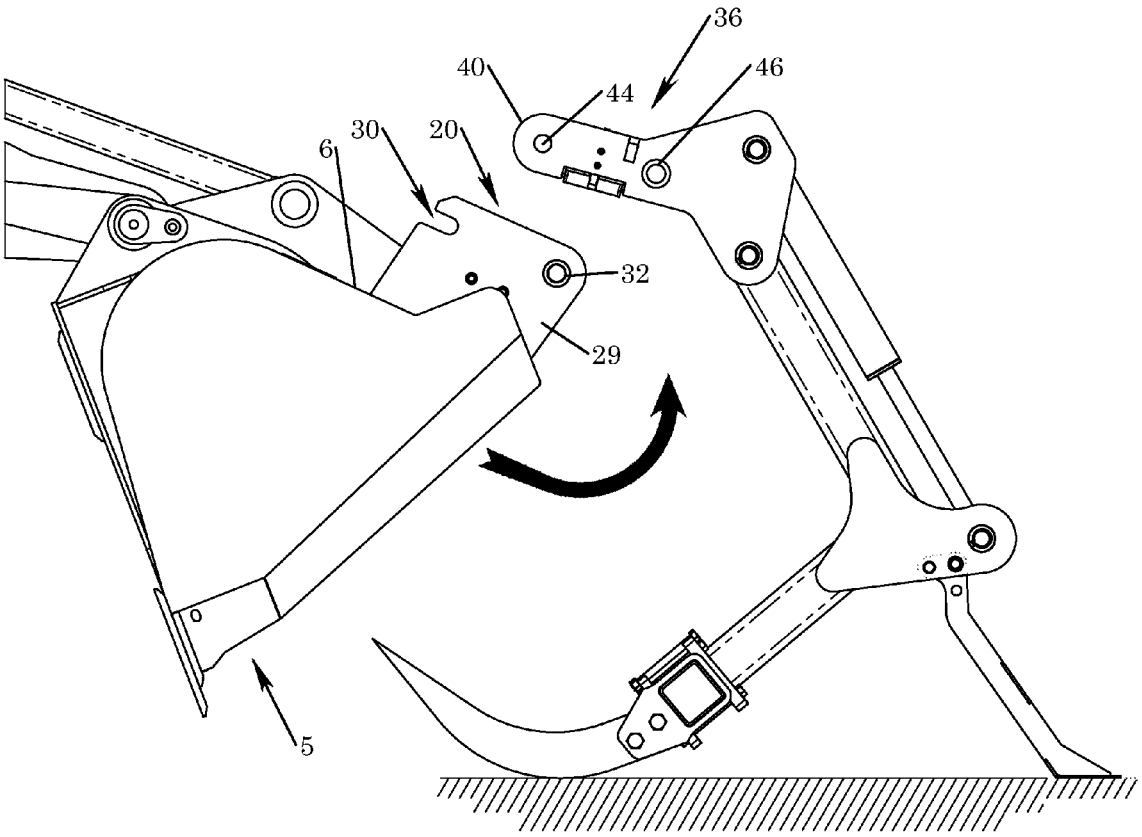
FIG. 3A is a schematic side view of the grapple in the parked position and a bucket approaching the grapple for connecting the grapple attachment structure on the grapple to the grapple mount structure on the bucket.
Figure 3B:
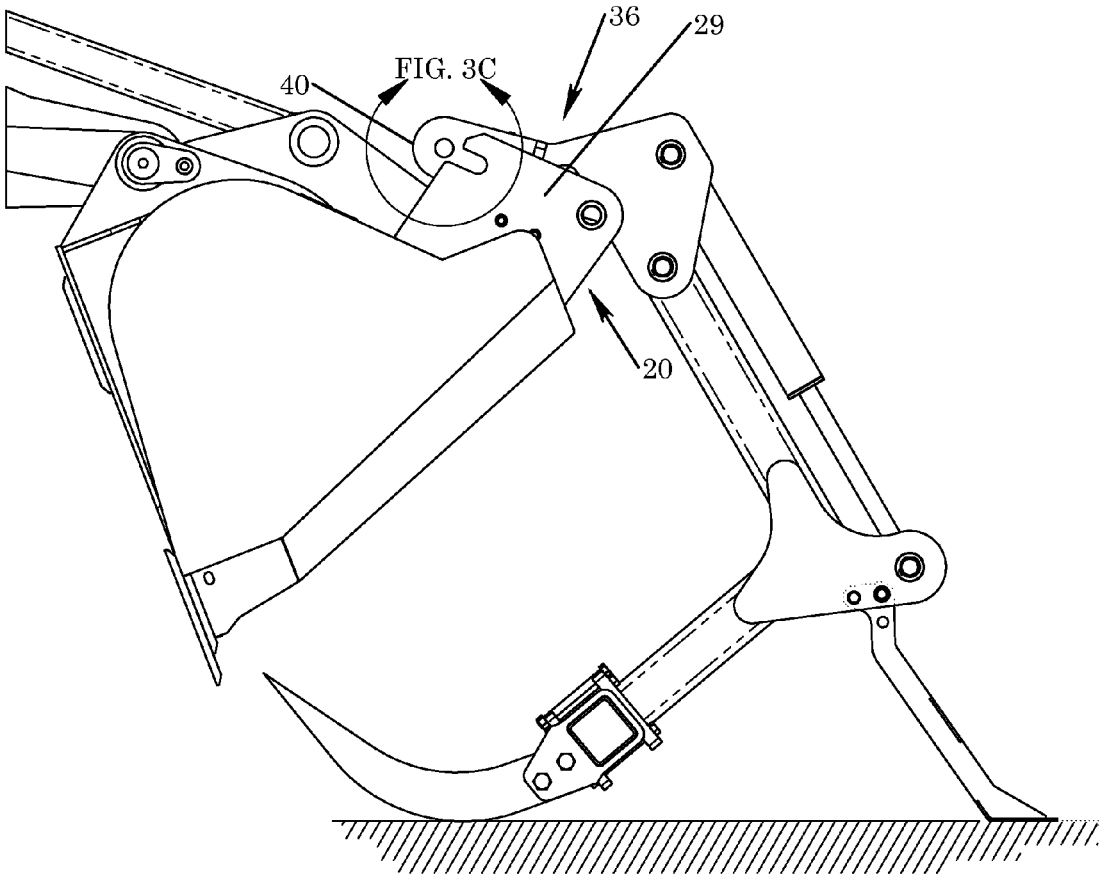
FIG. 3B is a schematic side view of the grapple in the parked position and the bucket with the grapple attachment structure on the grapple in position to engage the grapple mount structure on the bucket.
Figure 3C:
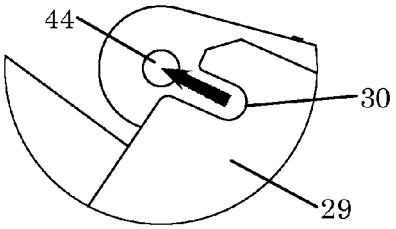
FIG. 3C is a schematic magnified side view of the mount plate of the grapple mount structure on the bucket being moved so that the hook pin on the grapple attachment structure moves into the hook on the mount plate.
Figure 3D:
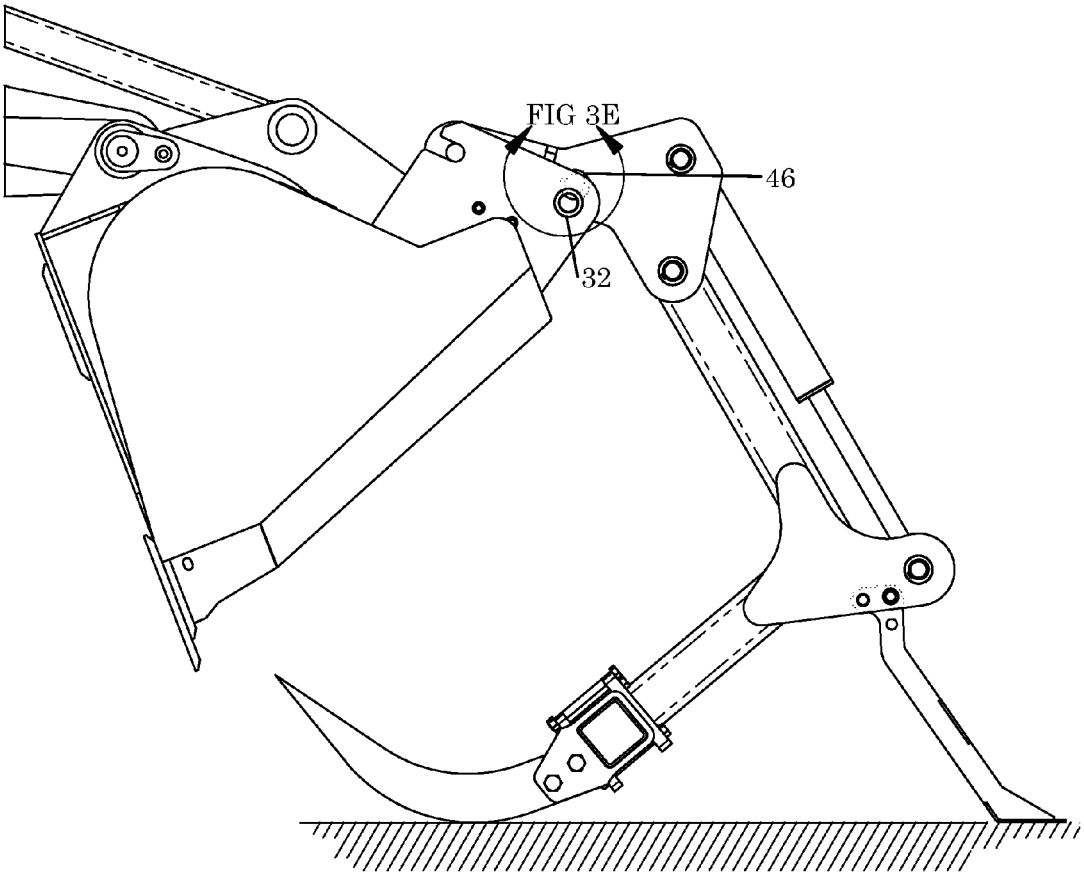
FIG. 3D is a schematic side view of the hook pin of the attachment structure lodged in the hook in the mount plate of the mount structure so that the bucket may be rotated to align the first pin aperture with the second pin aperture.
Figure 3E:
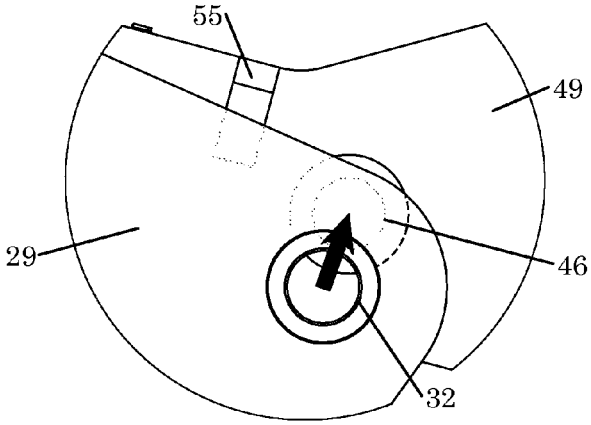
FIG. 3E is a schematic close up of the side view in FIG. 3D showing the first pin aperture on the mount plate of the mount structure approaching alignment with the second pin aperture on the attachment wall of the attachment structure.
Figure 3F:
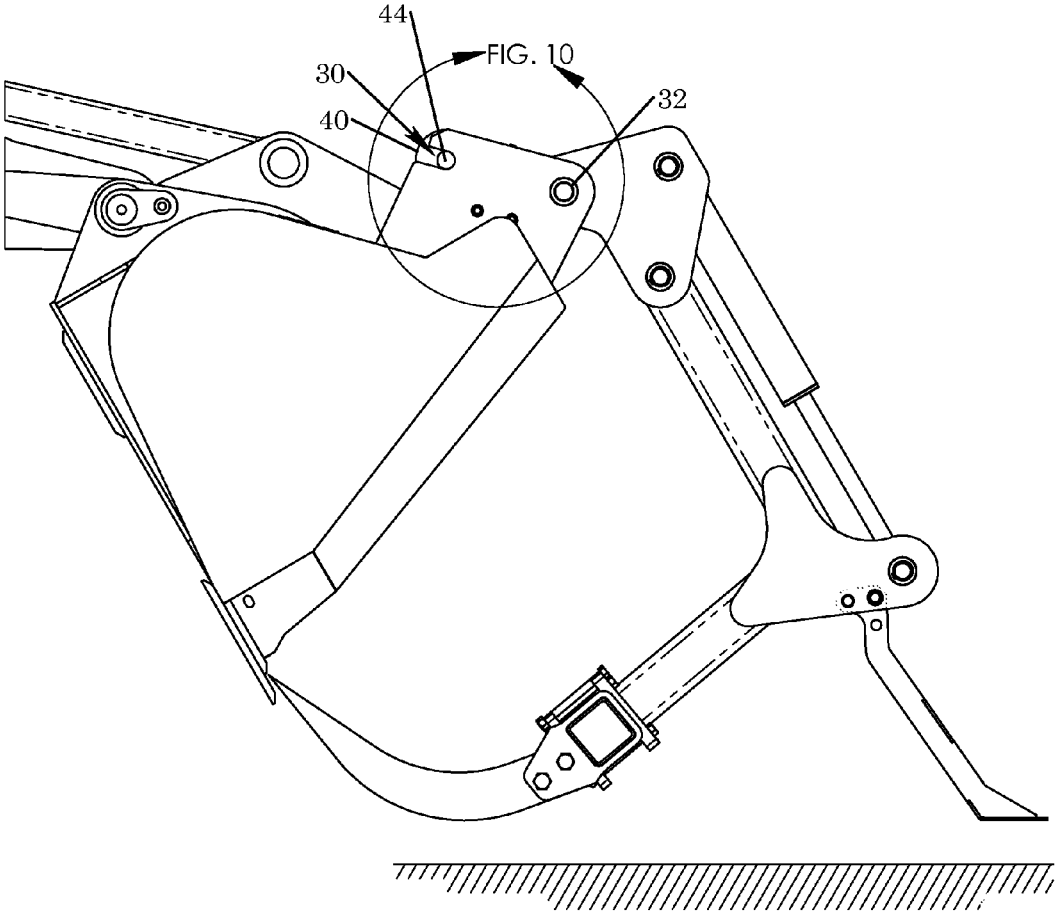
FIG. 3F is a schematic side view of the grapple and bucket showing the first pin aperture in the mount structure being aligned with the second pin aperture in the attachment structure such that the mount pin may be inserted through the apertures.
Figure 3G:
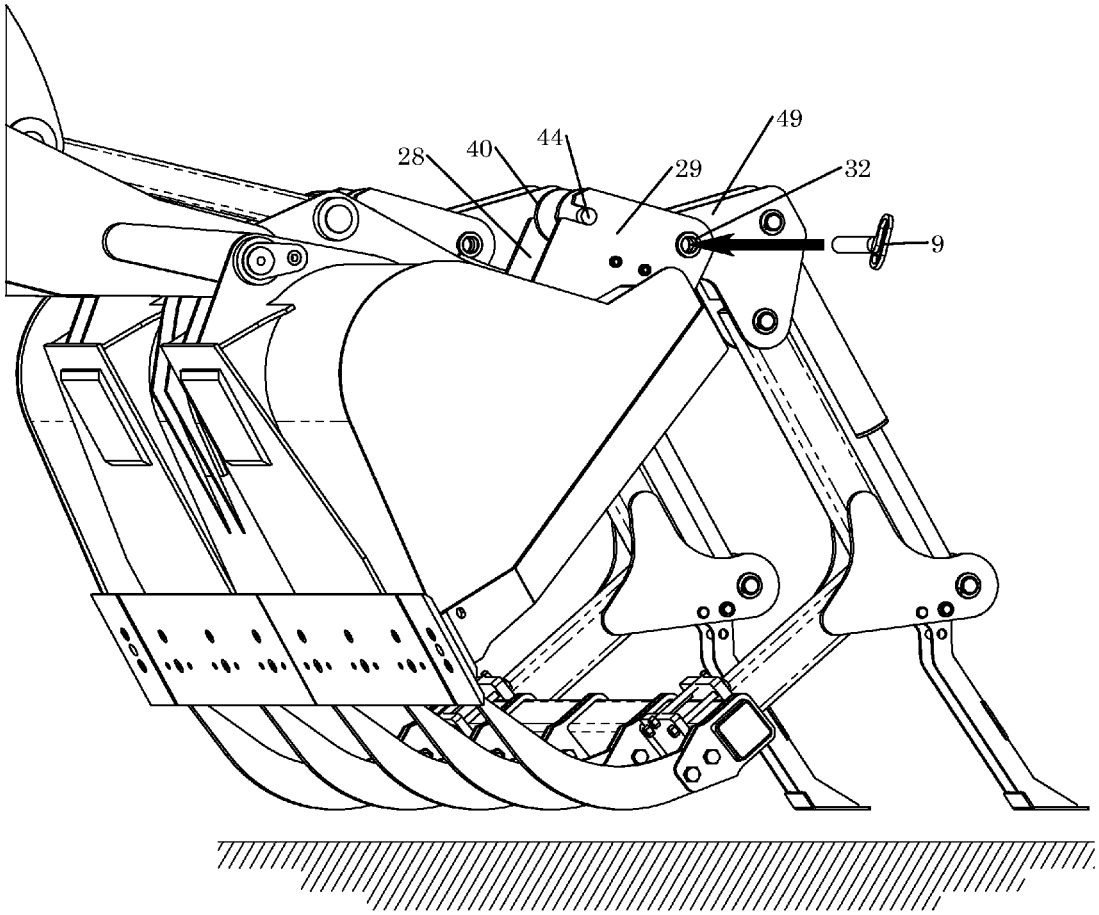
FIG. 3G is a schematic perspective view of the bucket and grapple demonstrating the insertion of the mount pin into the aligned first pin aperture and second pin aperture.
Figure 4:
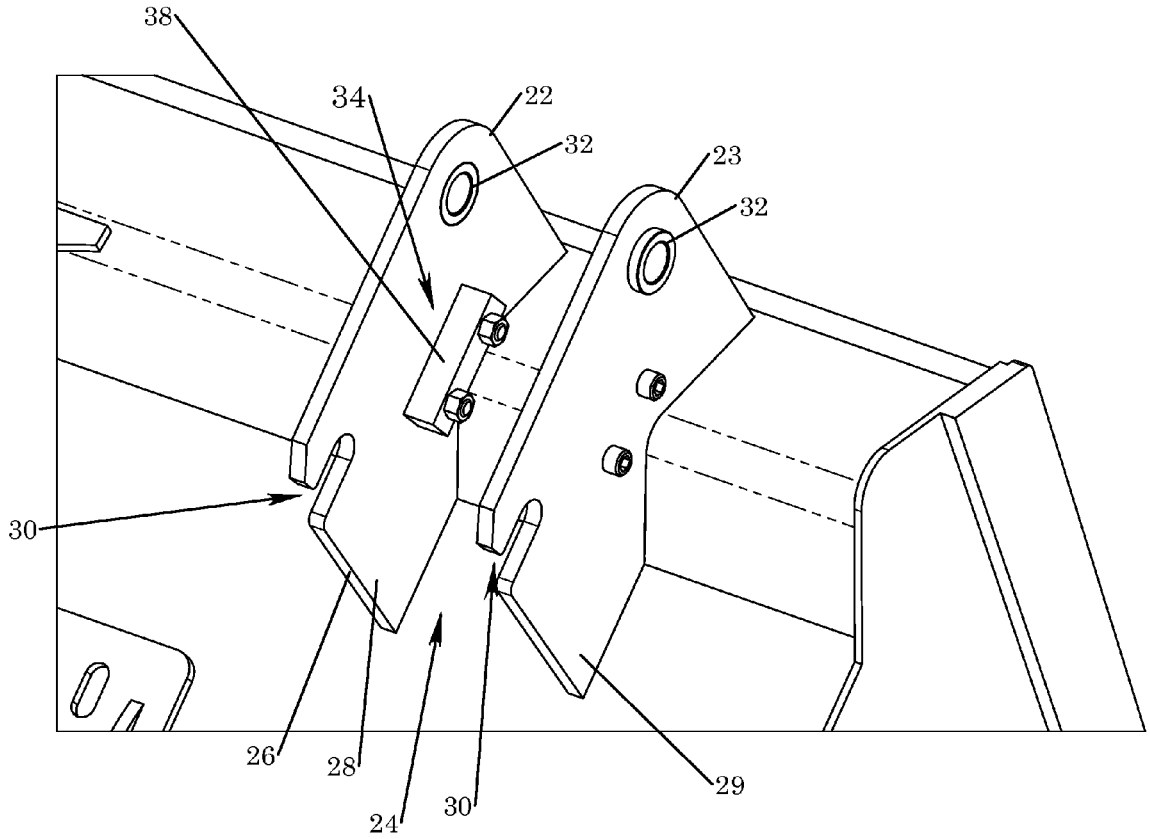
FIG. 4 is a schematic perspective view of one of the grapple mount structures with the grapple attachment structure dismounted, showing the mount plates and support shoulder mounted on the bucket.
Figure 5:
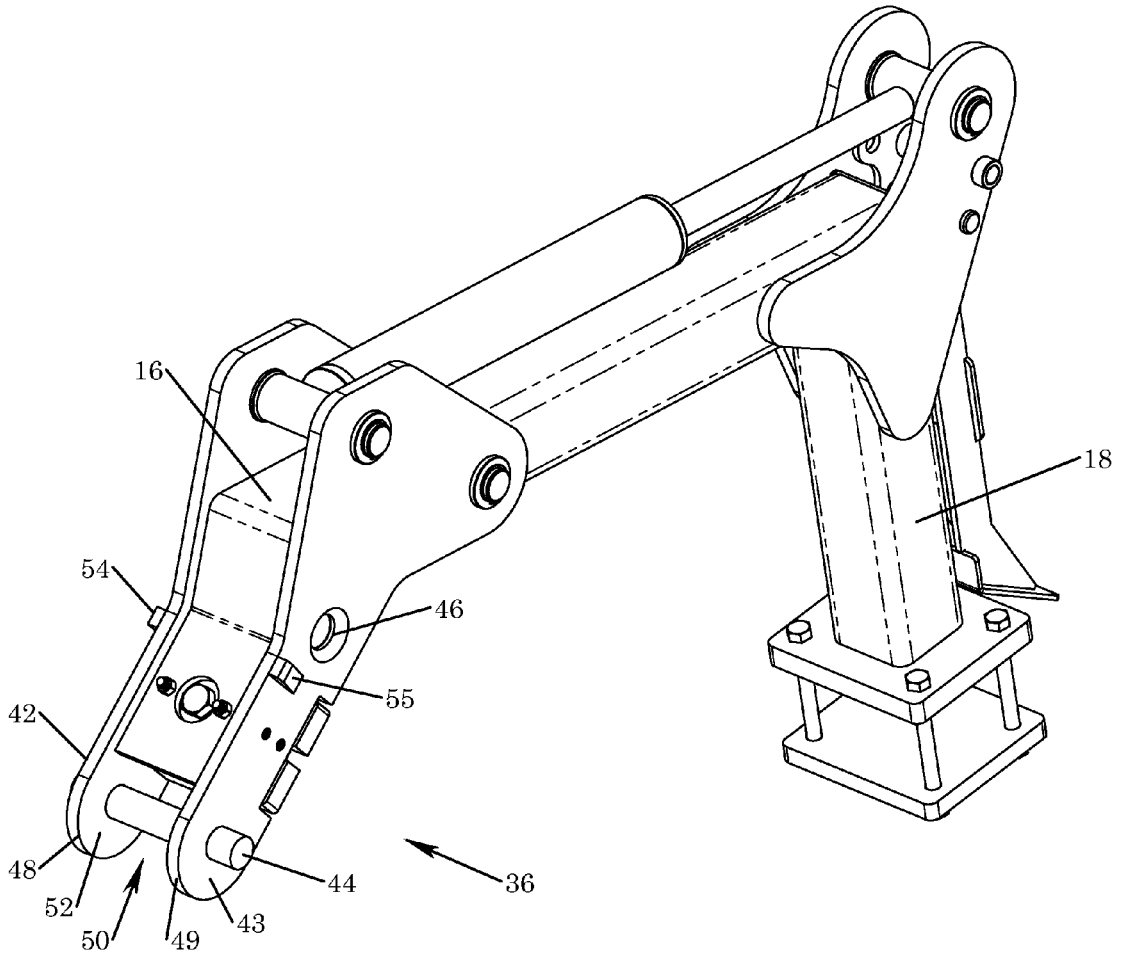
FIG. 5 is a schematic perspective view of a grapple arm and grapple attachment structure in a dismounted condition from the grapple mount structure.
Figure 6:
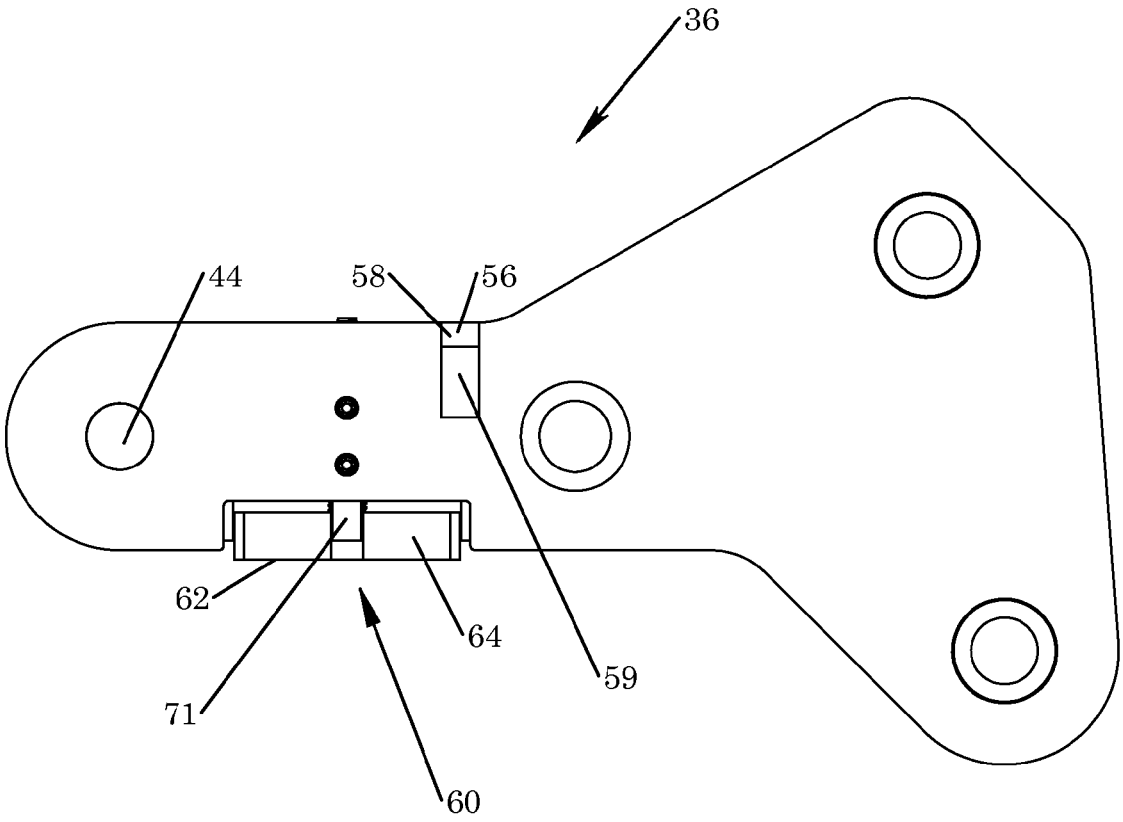
FIG. 6 is a schematic side view of a portion of the grapple attachment structure in the dismounted condition.
Figure 7:
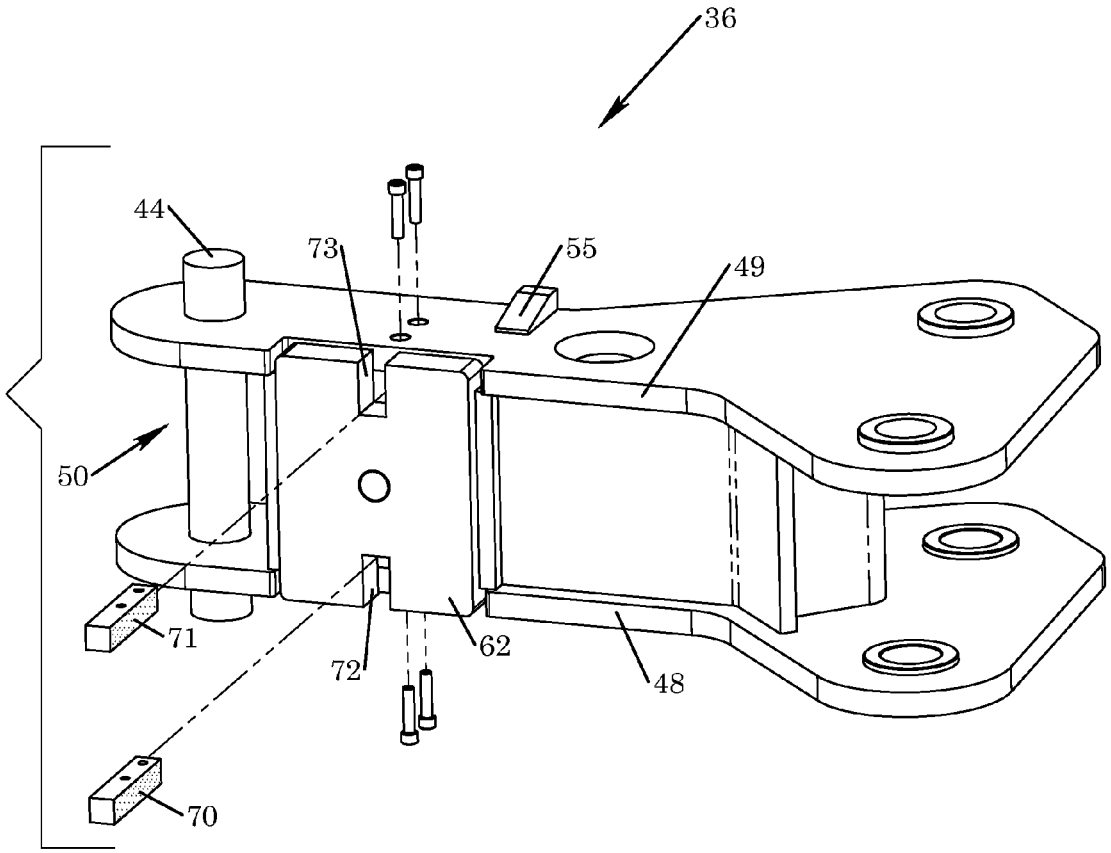
FIG. 7 is a schematic partially exploded perspective view of the grapple attachment structure in the dismounted condition.
Figure 8:
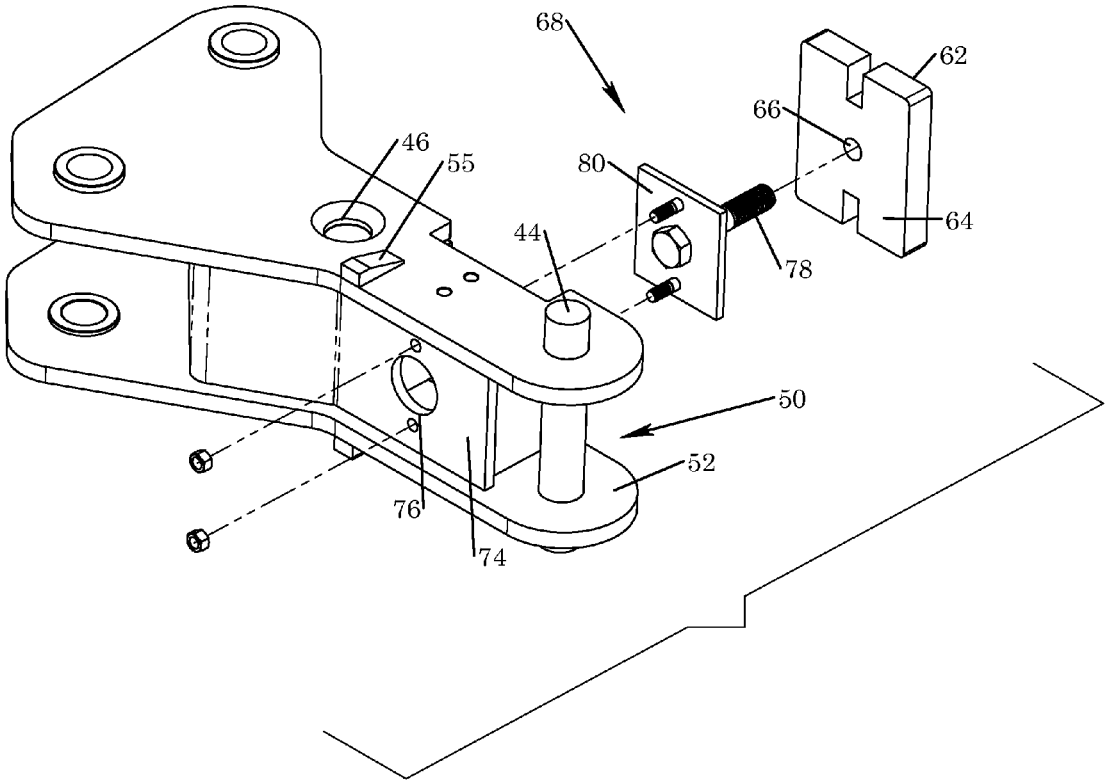
FIG. 8 is a schematic perspective view of the grapple attachment structure with the abutment surface adjustment structure shown in an exploded condition.
Figure 9:
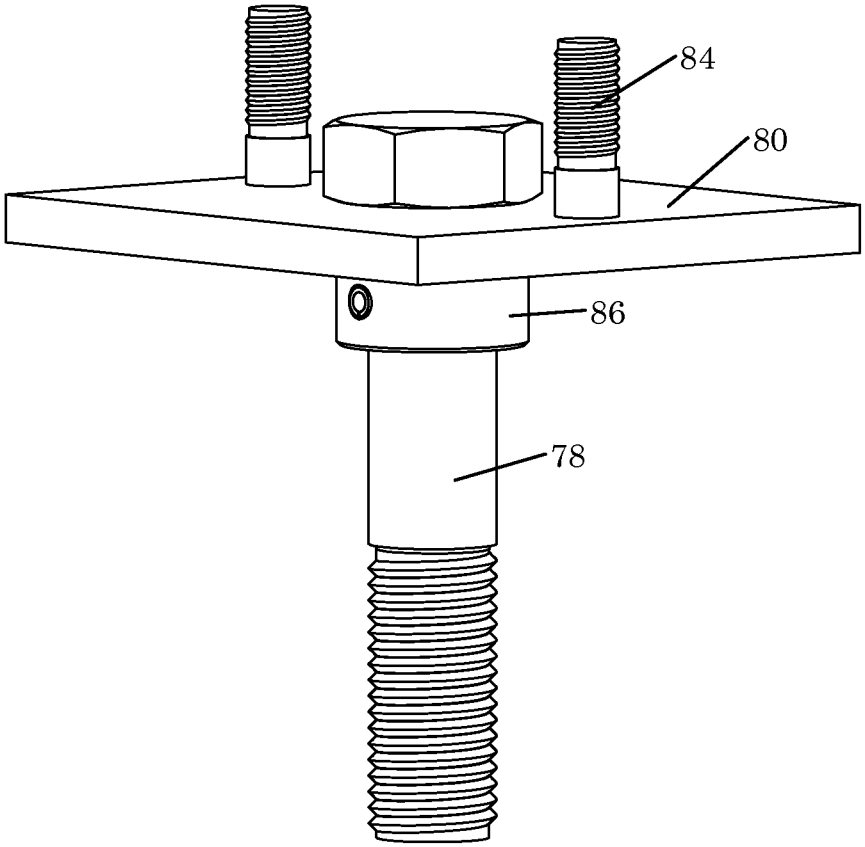
FIG. 9 is a schematic perspective view of a portion of the abutment surface adjustment structure shown isolated from the grapple attachment structure.
Figure 10:
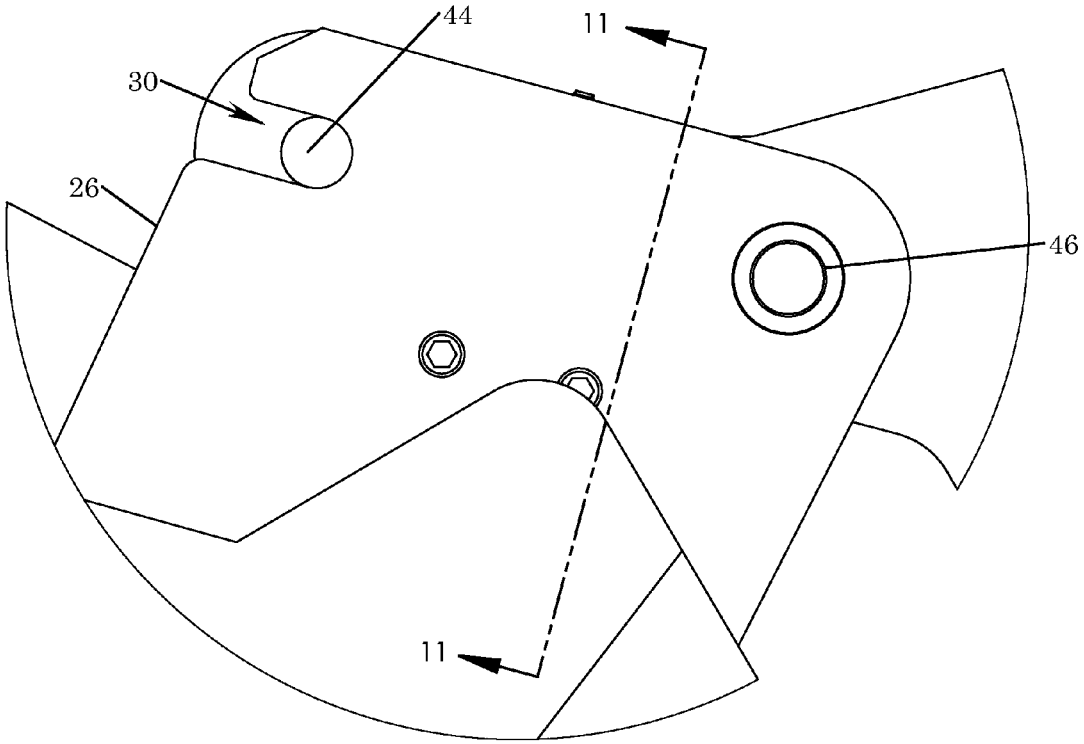
FIG. 10 is a schematic close up of FIG. 3F showing the grapple mount structure and the grapple attachment structure in a mounted condition.
Figure 11:
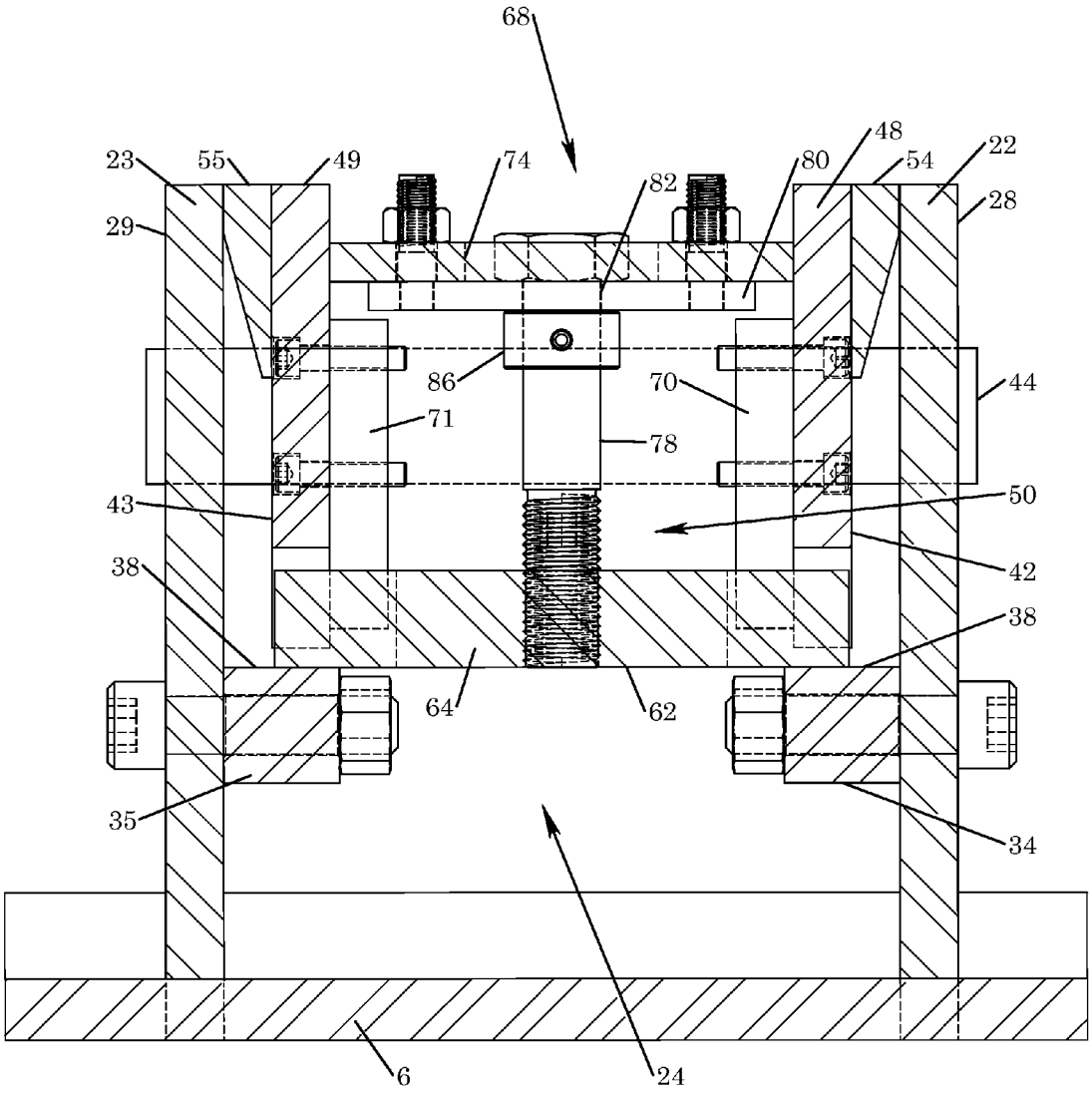
FIG. 11 is a schematic cross sectional view of the grapple mount structure and grapple attachment structure in the mounted condition taken along line 11-11 of FIG. 10.
Figure 12:
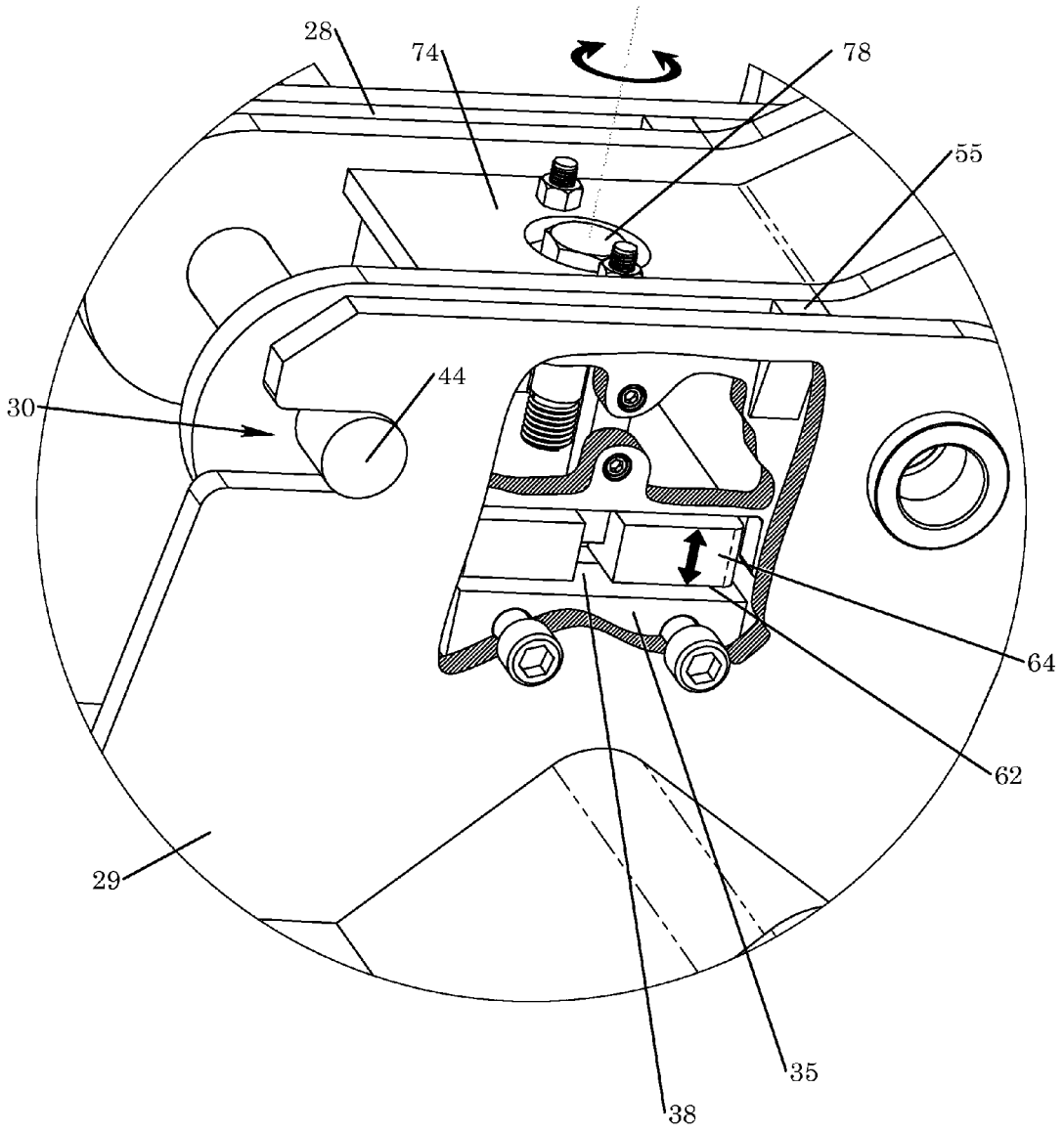
FIG. 12 is a schematic perspective view of the grapple mount structure and grapple attachment structure in a mounted condition with portions of the mount plate and attachment wall removed to show the relationship between the jacking member and the support shoulder.

The grapple system 10 may include a pair of the grapple attachment structures 36, with each being removably mountable to one of the grapple mount structures 20 so that the grapple mount structures and grapple attachment structures have a mounted condition (see e.g., FIG. 3(G) and a dismounted condition (see e.g., FIG. 3A). The grapple attachment structures 36 are preferably but not critically substantially identical in configuration, so the description will be directed to one attachment structure with the understanding that the other attachment structure may be substantially the same.

A grapple attachment structure 36 has a free end positionable in the reception space 24 of one of the grapple mount structures 20, and each grapple attachment structure may have a pair of lateral sides 42, 43 for positioning adjacent to the inner surfaces 28 of the mount plates 22, 23 of the grapple mount structure. A grapple attachment structure 36 may also include a hook pin 44 that is removably receivable in the hook 30 on at least one of the mount plates 28, 29. The hook pin 44 may be positioned toward the free end 40, and may extend laterally from the lateral sides 42, 43 of the grapple attachment structure. A grapple attachment structure 36 may further comprise a second pin aperture 46 that is alignable with the first pin aperture 32 in the mount plates when the structures 20, 36 are in the mounted condition. One advantage of the system may be to facilitate the alignment of the second pin aperture of the grapple attachment structure with the first pin aperture of the grapple mount structure.

The grapple attachment structure 36 may also include a pair of attachment walls 48, 49 forming at least a portion of the lateral sides 42, 43 of the attachment structure 36, and the walls 48, 49 may define an internal space 50 therebetween. The hook pin 44 may extend through each of the attachment walls 42, 43, and the second pin aperture 46 may extend through each of the attachment walls to accommodate the mount pin 9. Each of the attachment walls may have an internal surface 52 that faces the internal space 50.

A lateral mount alignment element 54 may be included on each grapple attachment structure 36 to laterally position the attachment structure 36 with respect to the mount structure 20. The lateral mount alignment element 54 may extend laterally from one of the attachment structures 36 to abut an adjacent one of the mount structures 20. A pair of the lateral mount alignment elements 54, 55 may be positioned and oriented in laterally opposite directions from the attachment structure 36. Each lateral mount alignment element 54, 55 may extend from one of lateral sides 42, 43 of the attachment structures 36. Each lateral mount alignment element 54, 55 may have an alignment surface 56.

Each lateral mount alignment structure may have a first portion 58 and a second portion 59. The first portion 58 may have a substantially uniform thickness such that a section of the alignment surface 56 on the first portion is positioned at a substantially uniform distance from the lateral side 42 on which the alignment element is located. The second portion 59 may extend from one end of the first portion, and may be tapered in thickness thicker toward the first portion and thinner away from the first portion such that a section of the alignment surface 56 on the second portion extends away from the lateral side 42 on which the alignment element is located. The second portion 59 may have a length that is longer than a length of the first portion, and in some embodiments the second portion has a length that is approximately three times a length of the first portion.

A mount pin alignment device 60 may be included on each of the grapple attachment structures 36 to align the second pin aperture 46 of the grapple attachment structure and the first pin aperture 32 of the corresponding grapple mount structure. The mount pin alignment device 60 may be used to adjust a rotational position of the grapple attachment structure on the hook pin with respect to the grapple mount structure. The mount pin alignment device 60 may include an adjustable abutment surface 62 for abutting against the support surface 38 of one of the support shoulders 34, 35 of the grapple mount structure. The position of the abutment surface 62 may be adjustable relative to a position of the second pin aperture 46 such that adjustment of the position of the abutment surface 62 changes the relative position of the second pin aperture with respect to the first pin aperture when the abutment surface 62 is abutted against the support surface 38 of the support shoulder on the grapple mount structure. The abutment surface 62 may be located on a jacking member 64, and the position of the jacking member may be adjustable. The jacking member 64 may be at least partially located in the internal space 50 between the internal surfaces 52 of the grapple attachment structure. The jacking member 64 may have a hole formed therein, and the hole may be threaded.

The mount pin alignment device 60 may further comprise an abutment surface adjustment structure 68 for moving the position of the abutment surface 62. The abutment surface adjustment structure may be configured to move the position of the jacking member 64 to thereby adjust the position of the abutment surface 62. The adjustment structure 68 may include at least one guide rail 70, and optionally a second guide rail, each mounted on one of the attachment walls 48, 49. The guide rail or rails may be located in the internal space 50, and the jacking member 64 may have complementary guide groove(s) 72, 73 that are configured to receive the (respective) guide rail. The guide rails 70, 71 may be positioned in the guide grooves 72, 73 as the jacking member moves such that the guide groove slides along the guide rail. Each guide rail 70, 71 may be positioned on the internal surface 52 of one of the attachment walls, and may be attached to the respective attachment wall.

The adjustment structure 68 may further include a base plate 74 that is located in the internal space 50 between the attachment walls, and may extend generally parallel to the jacking member 64. The base plate 74 may be fixedly attached to the attachment walls 48, 49 so as to be substantially immovable with respect to the walls. The base plate 74 may have an aperture 76 formed therein. An adjustment screw 78 may be configured to adjust the position of the jacking member 64, and the abutment surface 68 thereon. The adjustment screw 78 may extend through the base plate 74 and may have a shaft portion with threads formed thereon that are engaged with the threads of the hole 66 in the jacking member. Thus, rotation of the screw 78 in a first rotational direction moves the jacking plate (and the abutment surface 62) toward the base plate, and rotation of the screw in a second rotational direction moves the jacking plate (and surface 68) away from the base plate. The adjustment screw 78 may have a head portion that is configured to be engaged by a tool, such as by having a particular head perimeter shape or a cavity with a particular shape. The adjustment structure 68 may also include a keeper plate 80 that has a hole 82 therein through which the adjustment screw 78 passes. The adjustment structure 68 may also include at least one fastener 84 that connects the keeper plate 80 to the base plate 74. The adjustment structure 68 may further include a keeper collar 86 that is mounted on the adjustment screw such that the head portion of the screw and the keeper collar 86 are located on opposite sides of the keeper plate, the keeper collar being releasably fixed in position on the shaft portion of the adjustment screw.

In use, when dismounted, the grapple and grapple attachment structure may be rested on the ground and the grapple mount structure may be mounted on the bucket. The bucket may be moved toward the grapple and attachment structure using the loader such as is shown in FIG. 3A. The bucket may be rolled back to bring the pin 44 into proximity of the hook 30 and the mount plate may be moved backward to pull the hook about the pin (see FIG. 3C). Once the pin is seated in the hook, (see FIG. 3D), the bucket and grapple mount structure may be rotated back or rolled back to align the first pin aperture on the mount plate with the second pin aperture on the attachment wall (see FIG. 3E) so that the mount pin may be inserted to complete the mounting. Aligning the apertures quickly and repeatedly can be challenging, particularly for one person to accomplish, due to tolerances and wear that make the precise alignment of the apertures difficult to achieve from the cab of the loader. The abutment surface adjustment structure may be used to adjust the position of the jacking member, and thus the position of the abutment surface, so that the orientation of the mount structure with respect to the attachment structure when the jacking member contacts the support shoulder may be adjusted. Thus, the position of the jacking member may be adjusted to be in contact with the support shoulder when the mount pin is inserted through the pin apertures (and thus the apertures are aligned). Once the position of the jacking members has been adjusted for contact with the support shoulder when the apertures are aligned, then upon subsequent mounting operations the jacking member and support shoulder will block over rotation of the mount structure with respect to the attachment structure past the point of alignment. The operator of the loader can roll back on the bucket (after the pin 44 has been inserted into the hook 30) until contact is made between the jacking member and support shoulder and then know that the apertures are properly aligned so that the operator may exit the cab of the loader and insert the mount pin into the pin apertures. The position of the jacking member then only needs to be adjusted as needed, such as when parts wear and connections loosen.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A mounting system for mounting a grapple on a grapple mount structure for a loader attachment, the grapple including a grapple arm having a proximal end and a distal end, the grapple mount structure including mount plates with a reception space therebetween, the grapple mount structure forming a hook and a first pin aperture and having at least one support surface, the system comprising:

a grapple attachment structure located at a proximal end of the grapple arm and being removably mountable to the grapple mount structure, the grapple attachment structure having a mounted condition and a dismounted condition with respect to the grapple mount structure, the grapple attachment structure having a free end positionable in the reception space of the grapple mount structure, the grapple attachment structure having lateral sides for positioning adjacent to the mount plates of the grapple mount structure, the grapple attachment structure comprising:

a hook pin configured to be removably received in the hook of the grapple mount structure when in the mounted condition, the hook pin extending laterally from at least one of the lateral sides of the grapple attachment structure;

a second pin aperture alignable with the first pin aperture in the mount plates when the structures are in the mounted condition; and a mount pin alignment device having an abutment surface configured to contact the support surface of the grapple mount structure in the mounted condition, a position of the abutment surface of the mount pin alignment device being adjustable with respect to a position of the hook pin and with respect to a position of the second pin aperture to facilitate alignment of the second pin aperture of the grapple attachment structure with the first pin aperture of the grapple mount structure.

2. The system of claim 1 wherein the mount pin alignment device is configured to maintain an adjusted position of the abutment surface with respect to the position of the hook pin and the position of the second pin aperture while the grapple attachment structure is dismounted from the grapple mount structure.

3. The system of claim 1 additionally comprising a pair of attachment walls forming at least a portion of the lateral sides of the grapple attachment structure and defining an internal space therebetween; and wherein the abutment surface is positioned in the internal space.

4. The system of claim 1 wherein the abutment surface is located on a jacking member, a position of the jacking member being adjustable with respect to the positions of the hook pin and the second pin aperture along a line extending perpendicularly to a longitudinal axis of a shaft forming the hook pin and a longitudinal axis of a passage forming the second pin aperture.

5. The system of claim 4 additionally comprising a pair of attachment walls forming at least a portion of the lateral sides of the grapple attachment structure and defining an internal space therebetween; and wherein the jacking member is at least partially located in the internal space of the grapple attachment structure.

6. The system of claim 4 additionally comprising an abutment surface adjustment structure for moving the position of the jacking member to adjust the position of the abutment surface.

7. The system of claim 6 additionally comprising a pair of attachment walls forming at least a portion of the lateral sides of the grapple attachment structure and defining an internal space therebetween; and wherein the abutment surface adjustment structure includes:

a base plate fixedly attached to at least one of the attachment walls, the base plate extending generally parallel to the jacking member, the base plate having an aperture formed therein;

an adjustment screw for adjusting the position of the jacking member, the adjustment screw extending through an aperture in the base plate and a threaded hole in the jacking member, the threads of the screw being engaged with threads of the hole in the jacking member such that rotation of the screw changes the position of the jacking member with respect to the base plate.

8. The system of claim 7 wherein the abutment surface adjustment structure includes at least one guide rail mounted on one of the attachment walls and being received in a guide groove formed in the jacking member such that the guide rail slides along the guide groove.

9. The system of claim 1 additionally comprising a lateral mount alignment element to laterally position the grapple attachment structure with respect to the grapple mount structure.

10. The system of claim 9 wherein a pair of the lateral mount alignment elements extend laterally from the grapple attachment structure to abut against the grapple mount structure, each lateral mount alignment element having an abutment surface, portions of the abutment surfaces of the alignment elements diverge from each other in a lateral direction.

11. The system of claim 1 wherein the grapple attachment structure additionally comprises a pair of lateral mount alignment elements to laterally position the grapple attachment structure with respect to the grapple mount structure, the lateral mount alignment structures each extending from one of the lateral sides in laterally opposite directions with respect to each other from the grapple attachment structure for contacting inner surfaces of the mount plates of the grapple mount structure.

12. The system of claim 1 wherein the abutment surface is located between the position of the hook pin and the position of the second pin aperture.

13. The system of claim 1 wherein the position of the abutment surface of the alignment device limits a degree to which the hook pin is rotatable in the hook.

14. The system of claim 1 wherein the abutment surface of the alignment device of the grapple attachment structure is configured to rest upon the grapple mount structure to set a position of maximum rotation of the grapple attachment structure with respect to the grapple mount structure prior to insertion of the mount pin into the first and second pin apertures.

15. A mounting system for mounting a grapple on a bucket, comprising:

a grapple mount structure configured to mount on the bucket, the grapple mount structure including mount plates with a reception space therebetween, the grapple mount structure forming a hook and a first pin aperture and having at least one support surface; and a grapple attachment structure configured to mount on a proximal end of a grapple arm and being removably mountable to the grapple mount structure, the grapple attachment structure having a mounted condition and a dismounted condition with respect to the grapple mount structure, the grapple attachment structure having a free end positionable in the reception space of the grapple mount structure, the grapple attachment structure having lateral sides for positioning adjacent to the mount plates of the grapple mount structure, the grapple attachment structure comprising:

a pair of attachment walls forming at least a portion of the lateral sides of the grapple attachment structure and defining an internal space therebetween;

a hook pin configured to be removably received in the hook of the grapple mount structure when in the mounted condition, the hook pin extending laterally from at least one of the lateral sides of the grapple attachment structure;

a second pin aperture alignable with the first pin aperture in the mount plates when the structures are in the mounted condition; and a mount pin alignment device having an abutment surface configured to contact the support surface of the grapple mount structure in the mounted condition, a position of the abutment surface of the mount pin alignment device being adjustable with respect to a position of the hook pin and with respect to a position of the second pin aperture to facilitate alignment of the second pin aperture of the grapple attachment structure with the first pin aperture of the grapple mount structure.

16. The system of claim 15 wherein the abutment surface is located on a jacking member, a position of the jacking member being adjustable with respect to the positions of the hook pin and the second pin aperture along a line extending perpendicularly to a longitudinal axis of a shaft forming the hook pin and a longitudinal axis of a passage forming the second pin aperture.

17. The system of claim 16 wherein the mount pin alignment device is configured to maintain an adjusted position of the abutment surface with respect to the position of the hook pin and the position of the second pin aperture while the grapple attachment structure is dismounted from the grapple mount structure.

18. The system of claim 17 additionally comprising an abutment surface adjustment structure for moving the position of the jacking member to adjust the position of the abutment surface.

19. The system of claim 15 wherein the grapple attachment structure additionally comprises a pair of lateral mount alignment elements to laterally position the grapple attachment structure with respect to the grapple mount structure, the lateral mount alignment structures each extending from one of the lateral sides in laterally opposite directions with respect to each other from the grapple attachment structure for contacting inner surfaces of the mount plates of the grapple mount structure.

20. A mounting system for mounting a grapple on a grapple mount structure for a loader attachment, the grapple including a grapple arm having a proximal end and a distal end, the grapple mount structure including mount plates with a reception space therebetween, the grapple mount structure forming a hook and a first pin aperture and having at least one support surface, the system comprising:

a grapple attachment structure located at a proximal end of the grapple arm and being removably mountable to the grapple mount structure, the grapple attachment structure having a mounted condition and a dismounted condition with respect to the grapple mount structure, the grapple attachment structure having a free end positionable in the reception space of the grapple mount structure, the grapple attachment structure having lateral sides for positioning adjacent to the mount plates of the grapple mount structure, the grapple attachment structure comprising:

a hook pin configured to be removably received in the hook of the grapple mount structure when in the mounted condition, the hook pin extending laterally from at least one of the lateral sides of the grapple attachment structure;

a second pin aperture alignable with the first pin aperture in the mount plates when the structures are in the mounted condition; and a mount pin alignment device having an abutment surface configured to contact the support surface of the grapple mount structure in the mounted condition, a position of the alignment device with respect to the hook pin being adjustable to facilitate alignment of the second pin aperture of the grapple attachment structure and the first pin aperture of the grapple mount structure;

wherein the abutment surface is located on a jacking member, a position of the jacking member with respect to the hook pin being adjustable;

an abutment surface adjustment structure for moving the position of the jacking member to adjust the position of the abutment surface;

a pair of attachment walls forming at least a portion of the lateral sides of the grapple attachment structure and defining an internal space therebetween;

wherein the abutment surface adjustment structure includes:

a base plate fixedly attached to at least one of the attachment walls, the base plate extending generally parallel to the jacking member, the base plate having an aperture formed therein;

an adjustment screw for adjusting the position of the jacking member, the adjustment screw extending through an aperture in the base plate and a threaded hole in the jacking member, the threads of the screw being engaged with threads of the hole in the jacking member such that rotation of the screw changes the position of the jacking member with respect to the base plate;

wherein the abutment surface adjustment structure includes at least one guide rail mounted on one of the attachment walls and being received in a guide groove formed in the jacking member such that the guide rail slides along the guide groove.

* * * * *